US007828200B2

(12) United States Patent
Parow

(10) Patent No.: US 7,828,200 B2
(45) Date of Patent: Nov. 9, 2010

(54) EQUINE TRAINING DEVICE

(76) Inventor: Robin Parow, P.O. Box 343, Spencertown, NY (US) 12165

( * ) Notice: Subject to any disclaimer, the term of this patent is extended or adjusted under 35 U.S.C. 154(b) by 275 days.

(21) Appl. No.: 12/077,348

(22) Filed: Mar. 19, 2008

(65) Prior Publication Data

US 2008/0230593 A1 Sep. 25, 2008

Related U.S. Application Data

(60) Provisional application No. 60/918,778, filed on Mar. 19, 2007.

(51) Int. Cl.
*B68B 11/00* (2006.01)

(52) U.S. Cl. ..... 231/2.1; D30/156; 54/71

(58) Field of Classification Search ..... 231/2.1, 231/6; 54/71; 135/65, 66; D30/165, 156
See application file for complete search history.

(56) References Cited

U.S. PATENT DOCUMENTS

| | | | | |
|---|---|---|---|---|
| 3,799,429 A | | 3/1974 | Henry | |
| 4,082,302 A | * | 4/1978 | Albrecht | 280/816 |
| 4,111,444 A | * | 9/1978 | Clements, Jr. | 280/816 |
| 4,687,131 A | | 8/1987 | von Braunhut | |
| 4,858,125 A | * | 8/1989 | Washizuka et al. | 600/301 |
| 4,863,095 A | | 9/1989 | Crane | |
| 4,930,810 A | * | 6/1990 | Addison, Jr. | 280/821 |
| 5,303,954 A | * | 4/1994 | Suda | 280/819 |
| 6,065,670 A | | 5/2000 | Mahon | |
| 7,062,895 B1 | | 6/2006 | Sperie | |

FOREIGN PATENT DOCUMENTS

WO PCT/US2008/003595 6/2008

* cited by examiner

*Primary Examiner*—Rob Swiatek
(74) *Attorney, Agent, or Firm*—Saile Ackerman LLC; Stephen B. Ackerman

(57) ABSTRACT

An ergonomically designed timing module is integrated with an equine training whip, normally carried by the equestrian, especially for those needing to improve riding skills in point-to-point timed events such as cross country, stadium jumping, racing, barrel racing. This combination provides for safe operation and convenient viewing while in the saddle.

19 Claims, 3 Drawing Sheets

EQUINE TRAINING DEVICE

This application claims priority to U.S. Provisional application 60/918,778, filed on Mar. 19, 2007, and herein incorporated by reference in its entirety.

BACKGROUND OF THE INVENTION (1) Technical Field

The present invention is concerned with improvements to equine training devices and more particularly to a timing device built-in with a schooling whip for real time monitoring by riders participating in timed performance events.

(2) Description of the Prior Art

In most equine schooling activities, it is desirable that a rider pace or time their horse to obtain the smoothest movement providing maximum durability, style and control. A problem associated with conventional pacer-timer apparatus available in the prior art is that they are usually too large to be conveniently carried by the rider during schooling activities such as walking, trotting, cantering, jumping and the like.

Events for equestrians include all types of competitive events, i.e., cross-country 3-day eventing, endurance riding competitions, trail riding competitions, game events, and other racing venues, such as thoroughbred, quarter horse, Arabian horse and most types of driving competitions. All are time-based events. For example, the horse that completes the event in the shortest time period is the winner and the participants compete for money, trophies, prizes, or breeding revenues.

Using the hand-held stopwatch, from the ground, has long been the standby in conditioning the horse within all areas of competitive timed events in the equine industry.

The word whip describes two basic types of tools. A long stick-like device, usually slightly flexible, with a small bit of leather or cord, called a "popper", on the end. Depending on length and flexibility, this type is often called a dressage or schooling whip, riding crop or "bat". The other type of whip is a long tapered flexible length of single-strand or plaited (braided) material (usually leather) with a stiff handle. Each design has many variations and lengths for different purposes, often with different names.

The dressage or schooling whip should be as flexible as possible and weighty at the thick end so that its center of gravity lies in the user's hand.

To develop a good sense of timing, you first have to understand the exact sequence of the horse's footfalls within each gait whether it be the walk, trot, canter or gallop. A student must learn to feel each of those footfalls from the saddle in order to improve riding skills during point-to-point timed events. Only then will the student be able to time the application of their aids with the horse's footfalls.

SUMMARY OF THE INVENTION

A timing device is integrated within a schooling whip, normally carried by the equestrian, for the serious equestrian, especially for riders needing to improve riding skills in point-to-point timed events such as cross country, stadium jumping, racing, barrel racing, etc.

It is an object of the present invention to provide an ergonomically designed equine training apparatus for ease of operation and viewing while in the saddle. The equine training apparatus hereafter referred to as "equine timer whip " applies to all training whips whether allowing riders/equestrians to monitor real time while in the saddle or training while on the ground.

It is another object of the invention to provide a count down mode. Example: If riders know that they must complete a certain cross-country course in six minutes, they program the equine timer whip's timing device countdown mode to six minutes. As the riders gallop across the start gate, they activate the equine timer whip's start/stop button with their thumb. The count down begins, with audible beeps as each minute elapses, and double beeps as total time elapses. As the riders gallop the course, they are aware of the set timing by the minute beeps. The riders know the remaining time they have to complete the course, and can pace themselves or make up time to meet the cross-country time deadline.

It is still another object of the invention to provide a conditioning mode. Example: A Veterinarian prescribes an exercise fitness program for a horse just coming into work for the season. The Veterinarian's suggestion is a program of three minutes of trot, followed by three minutes of walk, followed by three minutes of trot, etc. The rider can use the count down feature at three minutes to accurately time the gaits, or program the count down feature for a thirty minute workout, listening for the minute beeps to signal elapsed time It is yet another object of the invention to provide a stopwatch function. Example: A hunter jumper needs to improve timing over fences. Rather than have an assistant stand at the gate with a stopwatch, the rider can program the equine timer whip for the stopwatch feature, using it as a timer. The riders activate the start/stop button with their thumb as they go over the first fence. The stopwatch counts up until the start/stop is pressed again upon completion of the final fence. Let's say the jump course took one minute fifty seconds. Now the rider has a baseline time for schooling the horse over the course. Riders can practice to improve by shaving off seconds to reach their desired time. Moreover, a jockey in preparing a thoroughbred for a race, must know the speed the horse must gallop to round the track to assess his time to consider if he qualifies for the running. This is an appropriate use of the stopwatch feature, eliminating the need for a third party to be standing at the gate and finish line with a stop watch.

Still yet another object of the invention is to provide an audible alarm and a light. Example: For riders who do overnight camping/trail rides, using the alarm feature will be helpful for waking up a camper for night checks, or waking a group for the morning ride. If a rider misplaces the equine timer whip around the barn, or drops it on a trail or cross country course, setting the alarm ensures that equine timer whip will signal its whereabouts at a prescribed time. The light is used to illuminate the module digits in low light situations.

Another object of the invention is to provide real time: Riders don't need to compromise their hand position to see real time. When wearing a wrist watch, the arm must be turned, forfeiting a proper connection with the horse's mouth. During winter riding, it is usually necessary to halt the horse to safely peel back layers of clothing to access the watch. During summer, riders who wear wrist watches frequently complain about the discomfort of dust, hay and dirt collecting underneath a wristwatch. Using the real time feature, a student or instructor can time a lesson. On the trail, a rider can calculate time away and be back to the barn on time. Trainers can accurately stay on time during their schooling sessions.

Other objects and a more complete understanding of the invention may be obtained by referring to the following specification and claims taken in conjunction with the accompanying drawings.

DETAILED DESCRIPTION OF THE PREFERRED EMBODIMENT

Figure 1:
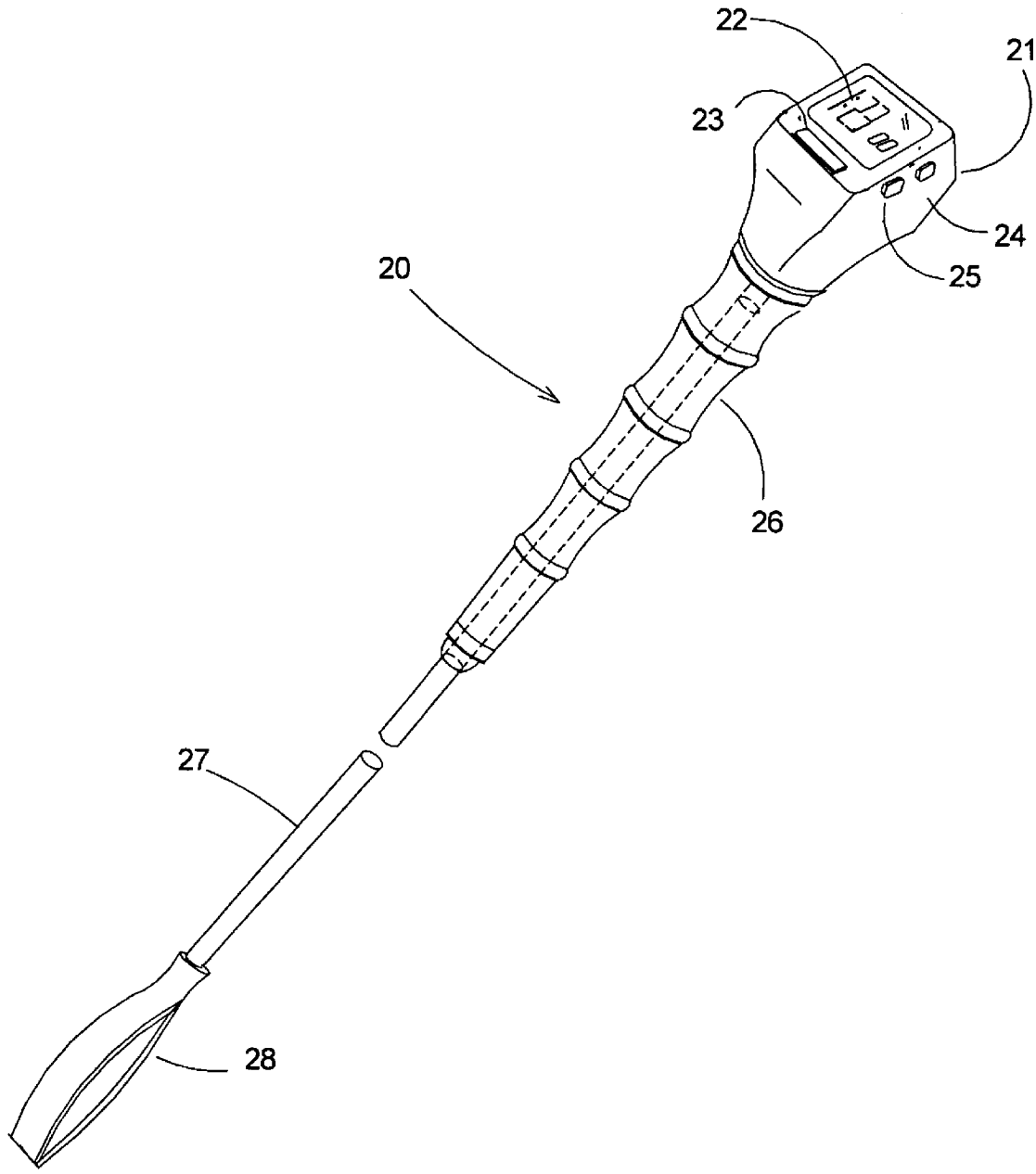
FIG. 1 illustrates a three dimensional view, of the invention.

Referring to the drawings and especially FIG. 1 thereof, an equine training whip as previously referred to as "equine timer whip" 20 is shown in a perspective illustrating sketch.

The integration of a timing device 22 with a schooling whip 27, normally carried by the equestrian, especially for riders needing to improve riding skills in point-to-point timed events such as cross country, stadium jumping, racing, barrel racing, etc, has previously not been disclosed. Where timing is primary, improved accessability is needed, especially while on the horse. The present invention will address this need with a novel design that includes a timing device packaged into a schooling whip The present invention provides an ergonomically designed whip apparatus for safe operation and viewing while in the saddle. The equine training apparatus here-after referred to as "equine timer whip" allows riders/equestrians to monitor real time without compromising their hand position when viewing the timing device during competitive eventing. The equine timer whip is a traditional riding whip with a digital module set into a cap cover 21. The equine timer whip can be made in a variety of popular colors, including black, neons, purple and blue, and the like.

Figure 2:
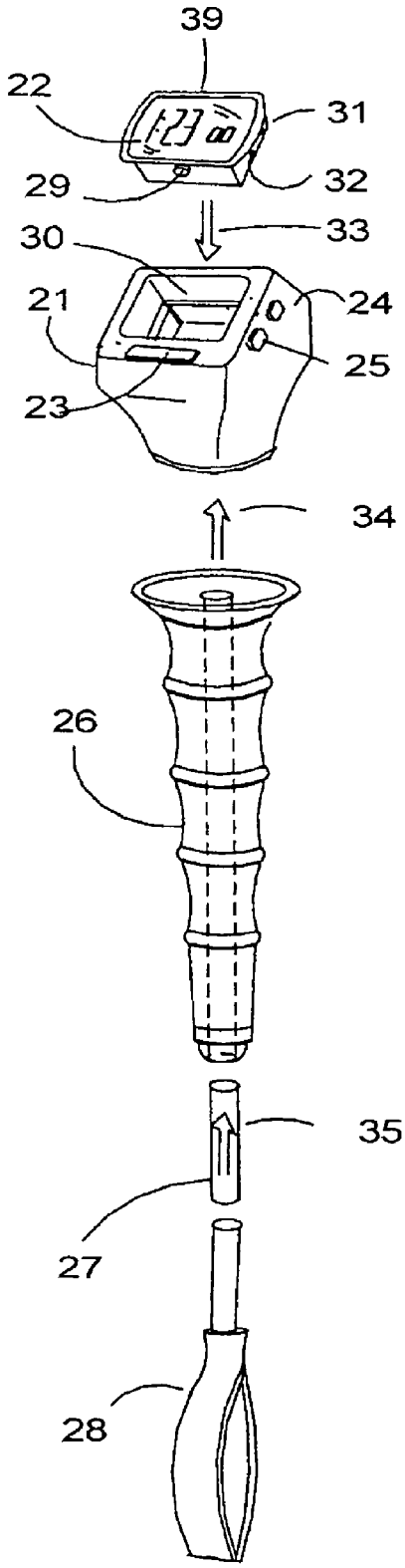
FIG. 2 shows an exploded view of the invention.

Referring also to FIG. 2 showing an exploded view of the equine timer whip. A digital timing module 22, powered with batteries that can be replaced, is hermetically encased within a housing 39. The timing module has a digital time display with digital numerals measuring at least 0.5 inch in height. The time display is easily readable from a distance of 24 inches. The batteries can be replaced. The housing 39 is placed and secured into a recessed cavity 30 molded in a cover 21. After placement of housing 39 into cavity 30, indicated by direction arrow 33, internal programmable buttons 29, 31 and 32 become aligned and superposed with external programmable buttons 23, 24 and 25 thereafter respectfully communicating when depressed. External button 23 is the "on-off" button, easily depressed with a rider's thumb, button 24 is the "mode" button, and button 25 is for setting a time interval. The location of buttons 24 and 25 may be interchanged. The cover is designed to provide visual comfort for the rider for viewing the digital display while holding the equine timer whip and reins.

Figure 3:
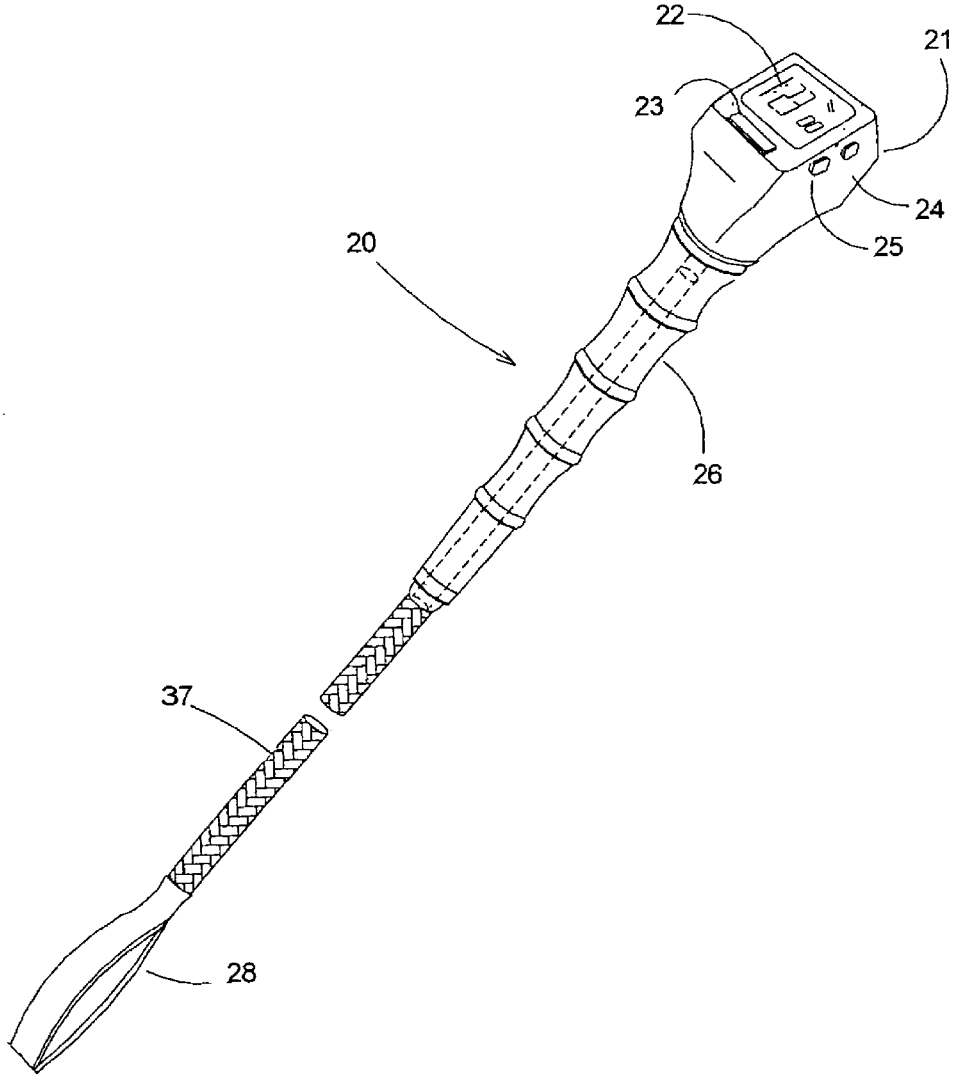
FIG. 3 illustrates an alternative three dimensional view of the invention.

A pliable hand grip 26, molded from a low durometer elastomer, for example, provides the rider with a cushioned and secure hold. The hand grip 26 having a top end and a bottom end is formed with finger recesses disposed longitudinally adding to the ease for holding the equine timer whip while the rider is in the saddle. The top end of the hand grip 26 may be demountably fastened and secured to the cover as shown by direction arrow 34. A pliant shaft 27, usually slightly flexible, having a first end pressed into a molded hole extending longitudinally from the bottom to the top end of the hand grip 26 as shown by direction arrow 35. A small bit of leather or cord, called a "popper" 28 is attached to the bottom end of the plaint shaft 27. Depending on length and flexibility, this type is often called a dressage or schooling whip, riding crop or "bat". The other type of whip is a long tapered flexible length 37 of single-strand or plaited (braided) material (usually leather) with a stiff handle, as shown in FIG. 3. Each design has many variations and lengths for different purposes, often with different names. The equine timer whip applies to both types and should be as flexible as possible and weighty at the thick end so that its center of gravity lies in the user's hand.

In accordance with the invention, the method of applying a "countdown" mode is to program the equine timer whip's timing device to a specific set time interval by depressing the mode button 24 until "countdown" appears and then setting the time interval by depressing the set button 25. The time interval begins by depressing the start/stop button 23. The count down begins, with audible beeps as each minute elapses, and double beeps as total time elapses In order to apply a "conditioning" mode prescribed as an exercise fitness program, the rider can use the count down feature by depressing the mode button 24 and setting the time interval by depressing the set button 25 to accurately time the gaits, or can program the count down feature for a prescribed workout while listening for the minute beeps to signal elapsed time Moreover, a hunter jumper needs to improve timing over fences. Rather than have an assistant stand at the gate with a stopwatch, the rider can program Equine timer whip for the stopwatch feature, using it as a timer. The riders activate the start/stop button 23 with their thumb as they go over the first fence. The stopwatch counts up until the start/stop is pressed again upon completion of the final fence. Let's say the jump course took one minute fifty seconds. Now the rider has a baseline time for schooling the horse over the course. Riders can practice to improve by shaving off seconds to reach their desired time. Additionally, a jockey in preparing a thoroughbred for a race, needs to know the speed at which the horse must gallop to round the track to assess his time to consider if he qualifies for the running. This is an appropriate use of the stopwatch feature, eliminating the need for a third party to be standing at the gate and finish line with a stop watch.

Another feature of the invention is to provide an audible alarm for riders going on overnight camping/trail rides. Using the alarm feature for waking up a camper for night checks, or waking a group for the morning ride. If a rider misplaces the equine timer whip around the barn, or drops it on a trail or cross-country course, setting the alarm ensures that the equine timer whip will signal its whereabouts at a prescribed time.

Riders don't need to compromise their hand position to check for time. When wearing a wristwatch, the arm must be turned, forfeiting a proper connection with the horse's mouth. During winter riding, it is usually necessary to halt the horse to safely peel back layers of clothing to access the watch. During summer, riders who wear wristwatches frequently complain about the discomfort of dust, hay and dirt collecting underneath a wristwatch. Using real time, a student or instructor can time a lesson. On the trail, a rider can calculate time away and be back to the barn on time. Trainers can accurately stay on time during their schooling sessions.

While the invention has been particularly shown and described with reference to the preferred embodiments thereof, it will be understood by those skilled in the art that various changes in form and details may be made without departing from the spirit and scope of the invention.

What is claimed is:

1. An equine timer whip for use by equestrians, said whip used primarily in equine training as an extension of the human arm to give commands to horses by gently tapping them, said whip comprising:

i. a shaft grip of a suitable length, said shaft having a first end and a second end, said first end inserted longitudinally into a bottom end passage of a molded handle grip and extending to its top end where-on a cap cover is inserted, said cap cover having cavity means for receiving a modular housing, ii. said modular housing containing a programmable timing device comprising:

a digital display;

on-off means for starting and stopping time measurement;

means for setting time intervals for equine time conditioning; and means for measuring elapsed time, setting an audible alarm, stop watch, and count down functions; and iii. said second end of said shaft comprising a flexible popper means.

2. The equine timer whip according to claim 1 wherein said grip is molded using an elastomeric material selected from the group consisting of thermoplastic polyurethane or silicone having a minimum durometer (hardness) of 60 Shore A.

3. The equine timer whip according to claim 1 wherein said digital display comprises a liquid crystal digital display having a minimum font size of 0.5 inch facilitates viewing resolution at a distance of at least twenty-four inches.

4. The equine timer whip according to claim 1 wherein said digital display is illuminated for checking time during the night by depressing a button.

5. The equine timer whip according to claim 1 wherein said cap cover cavity means having a slanted face facilitates visual accessibility of said digital display permitting said equestrians to comfortably hold reins and said equine timer whip.

6. The equine timer whip according to claim 1 wherein said cap cover is demountably assembled.

7. The equine timer whip according to claim 1 wherein said cap cover with cavity means removeably receives said modular housing.

8. The equine timer whip according to claim 1 wherein said modular housing containing said timing device is hermetically sealed against the entry of dust and water.

9. The equine timer whip according to claim 1 wherein said means for setting time functions are easily accessible using the same hand as for holding said grip.

10. The equine timer whip according to claim 1 wherein said shaft is a pliant shaft ending in said flexible popper means.

11. The equine timer whip according to claim 10 wherein said whip comprises a dressage or schooling whip, longe whip, riding crop, or "bat" depending on length and flexibility of said pliant shaft.

12. The equine timer whip according to claim 1 wherein said handle grip is a stiff grip and wherein said shaft comprises a long tapered flexible length of single-strand or plaited material ending in said popper means.

13. A method of training horses comprising the steps of:

providing an equine timer whip comprising riding whip having a digital timing device set into its grip wherein said digital timing device comprises:

timing means for measuring elapsed time;

a stopwatch function;

a countdown means with an audible signal at a specific set time interval;

an alarm for setting a specific time awareness, and a light to illuminate module digits in low light situations; and any one or more of timing, conditioning, and schooling horses and riders using said digital timing device.

14. The method of claim 13 wherein said grip is ergonomically designed for viewing said digital timing device while holding said grip and reins.

15. The method of claim 13 wherein said digital timing device has a digital font size that is at least 0.5 inch high for reading at a distance of 25.0 inches.

16. The method of claim 13 wherein said digital timing device integrated with said riding whip allows riders to improve riding skills in point-to-point timed events such as cross country, stadium jumping, racing, etc.

17. The method of claim 13 wherein said digital timing device allows equestrians to accurately time condition and school horses.

18. The method of claim 13 wherein said riding whip is selected from the equine group comprising dressage or schooling whip, longe whip, riding crop, or "bat" and whips having a long tapered flexible length of single-strand or plaited material with a stiff handle and of varied lengths used for different training purposes and wherein said riding whip comprises a flexible popper means at its end.

19. The method of claim 13 wherein said digital timing device is used for any one or more of measuring elapsed time, counting down time remaining in an exercise, keeping track of real-time, and setting an alarm to sound at a future time.

* * * * *